United States Patent [19]

Karamian

[11] 4,418,040

[45] Nov. 29, 1983

[54] LABORATORY STAND ASSEMBLY

[76] Inventor: Narbik A. Karamian, 7609 Exeter Rd., Bethesda, Md. 20014

[21] Appl. No.: 304,308

[22] Filed: Sep. 21, 1981

[51] Int. Cl.[3] ..... B01L 9/00; B01L 11/00

[52] U.S. Cl. ..... 422/101; 73/863; 248/125; 248/146; 422/88; 422/104

[58] Field of Search ..... 422/104, 101, 88; 248/94, 125, 146, 229, 231; 73/863

[56] References Cited

U.S. PATENT DOCUMENTS

| | | | |
|---|---|---|---|
| 2,683,579 | 7/1954 | Wallace | 248/146 |
| 2,784,577 | 3/1957 | Beaham | 248/146 |
| 2,966,430 | 9/1951 | Sobers | 422/104 |
| 3,111,296 | 11/1963 | Ludes | 248/226.5 |
| 4,064,737 | 12/1977 | Sleverin | 73/17 R |

FOREIGN PATENT DOCUMENTS

| | | | |
|---|---|---|---|
| A 19152 | 3/1956 | Fed. Rep. of Germany | 248/94 |

*Primary Examiner*—Michael S. Marcus
*Attorney, Agent, or Firm*—Joseph P. Nigon

[57] ABSTRACT

A laboratory stand assembly for use in emptying sample vials used to monitor the concentration of solvent vapor in air. The assembly consists of a base, a support extending vertically therefrom with a sample holder adjustably positioned in the support. A clamp is attached to the top of the sample holder to secure the adsorption tube to the sample holder. Support means for receiving a sample vial are also provided.

4 Claims, 2 Drawing Figures

LABORATORY STAND ASSEMBLY

BACKGROUND OF THE INVENTION

Laboratory stand assemblies are well known in the art and are widely used in industrial research facilities.

U.S. Pat. No. 4,064,737 describes an assembly for use in the analysis of the lead and tin or lead, tin and silver components of the solder use to seal the side seam in a three piece can.

U.S. Pat. No. 3,630,683 describes a reactor device for ion exchange resins, and

U.S. Pat. No. 3,873,449 relates to a laboratory device for skimming filters.

The emphasis on safety in the chemical industry has resulted in the development of equipment to monitor the concentration of solvent vapors such as benzene, toluene etc., in the air in industrial plants using or manufacturing these solvents in their processes. In one of the devices used for this purpose, the air in the workplace is sampled by drawing it thru an adsorption tube containing an ingredient such as silica gel or charcoal that will adsorb the chemical contaminates from the air. These adsorption tubes frequently are separated into compartments by plugs of glass wool or similar material. In essentially all of these tubes glass wool is used in both ends of the tubes to confine the adsorbent. These tubes are commercially available. These tubes typically contain about 50 to 900 mgs of adsorbent. This method of monitoring solvent vapors is described in the article by L. D. White et al entitled "A Convenient Optomized Method for the Analysis of Selected Solvent Vapors in the Industrial Atmosphere" that was published in the Journal of the American Industrial Hygiene Association Vol. 31 page 225 (1971).

After sampling for the desired period of time the adsorption tubes are removed and the amount of solvent vapors determined in the laboratory. Since the tubes are small, several problems have been encountered in this analysis. It is difficult for the chemist to remove the adsorbent particles from the tubes quantitatively without encountering some loss.

Accordingly it is an object of this invention to provide a novel stand assembly which permits accurate and reproducible measurements.

It is also an object of this invention to provide such an assembly which facilitates handling of the adsorption tubes used in monitoring solvent vapors in laboratory and industrial atmospheres.

It is a further object of this invention to provide such an assembly which affords safeguards against loss of a portion of adsorbent from the tubes during transfer.

It is another object of this invention to provide such a novel assembly which is relatively simple and inexpensive, durable and convenient to use.

SUMMARY OF THE INVENTION

It has now been found that certain of the foregoing objects can be readily attained in an assembly including a stand with an upright support member positioned thereon. An adsorptive tube bracket is mounted on the top of the support with means to clamp the adsorptive tube thereon. A donut shaped holder is positioned adjacent to the upright support. The holder is designed to accommodate a sample receiving vial. A funnel structure with a cut out portion on one side thereof is designed to fit into the sample receiving vial. dr

DETAILED DESCRIPTION OF THE ILLUSTRATED EMBODIMENTS

Figure 1:
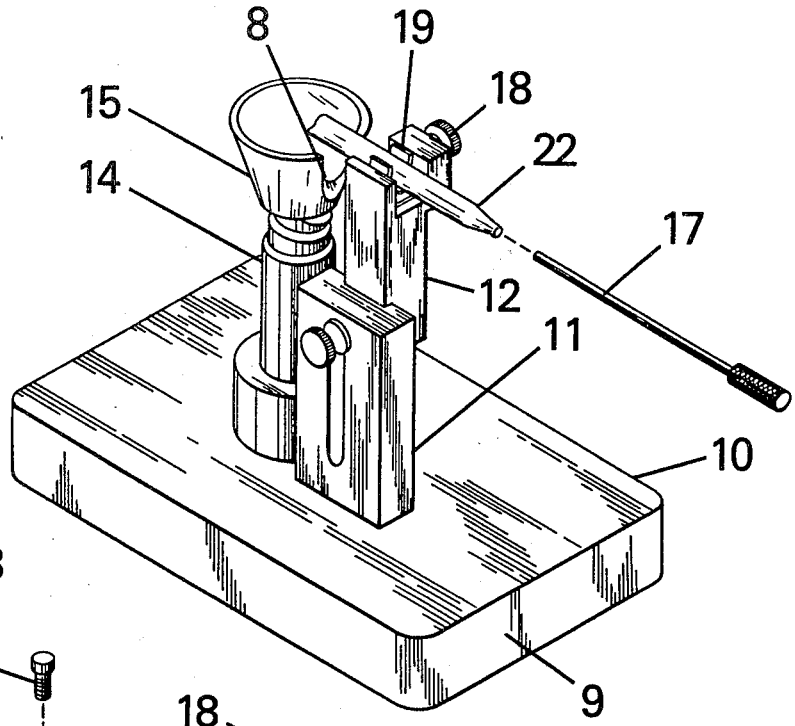
FIG. 1 is a perspective view of the novel laboratory stand assembly embodying the present invention.

Referring now to FIG. 1 illustrating the novel laboratory stand assembly embodying the present invention and including a stand generally designated 10 having a base 9 which supports a generally rectangular upright support member 11 having a sample support holder 12 adjustably attached thereto. A donut shaped holder 13 is also attached to the base 9 and serves as a holder for a sample receiving vial 14. A funnel member 15 is designed to fit into the mouth of the sample receiving vial 14. The funnel has a cut out portion 8, extending downwardly from the top thereof. The sample holder 12 includes a clamping member 19 designed to hold the adsorption tube 22. A probe member 17 is designed to fit through the open end of the adsorption tube 22 to force the adsorbent therefrom into the funnel 15.

Figure 2:
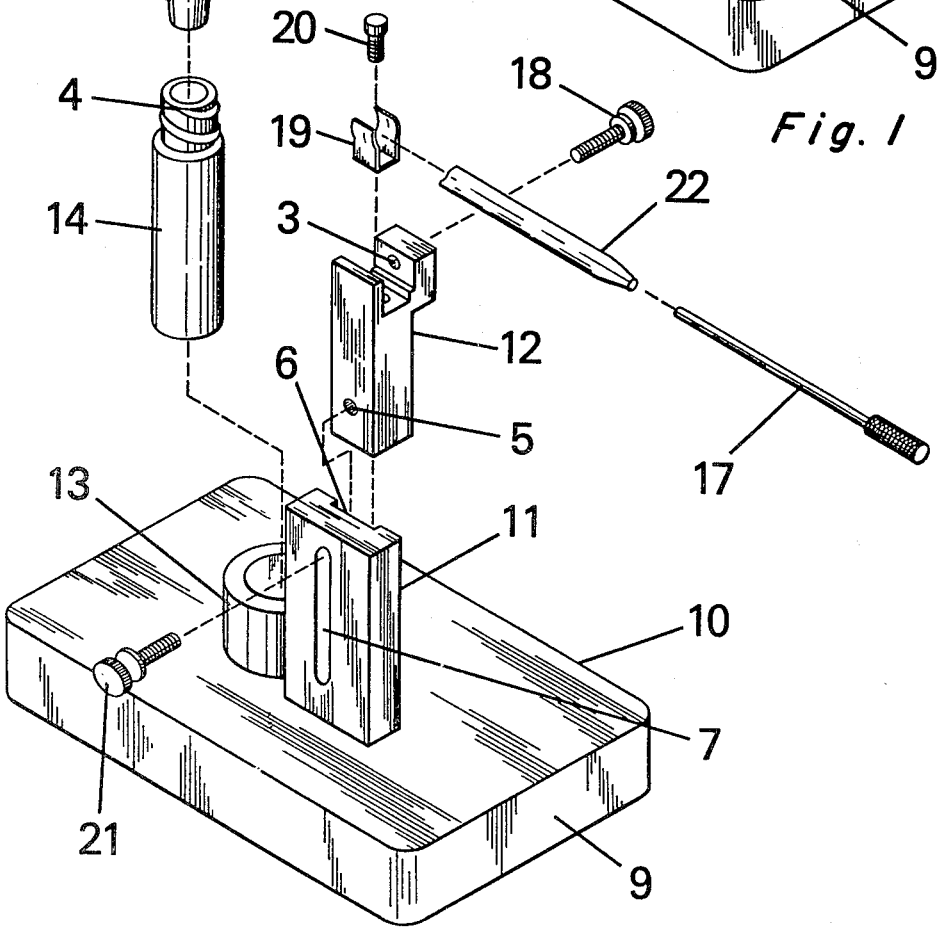
FIG. 2 is a front perspective view of the assembly showing the component parts in more detail.

Referring now to FIG. 2 which shows the details of the assembly. The base 9 has an upright support member 11 attached thereto. The sample holder 12 is designed to fit into the cut out portion 6 and is vertically adjustable. The sample holder 12 is held in place by set screw 21 which extends through the slot 7 and is screwed into the threaded aperture 5 in the sample holder 12. A donut shaped holder 13 is attached to the base 9 and is designed to accommodate a sample vial 14. The sample vial 14 has a threaded top 4 designed to accommodate a funnel 15. The funnel 15 has a cut out portion 8 extending from the top thereof and a screen member 16 therein to separate the glass wool plugs removed from the adsorption tubes from the adsorbent. The adsorption tube 22 is clamped into the sample holder by means of a clamp 19 held in position by a set screw 20. The clamp 19 is tightened about the adsorption tube by means of a set screw 18 which is positioned in threaded aperture 3 in the top of the sample holder 12. A probe 17 is provided to force the adsorbent from the adsorption tube 22.

In use the adsorption tube 22 is cut at both ends to allow the probe 17 to enter. The adsorption tube is clamped in the sample holder in clamp 19 and clamp 19 is adjusted by the set screw 18 to hold the adsorption tube firmly in place. The probe 17 is inserted into the tube 22 and is moved forward to force the glass wool plug or plugs and the adsorbent (not shown) from the tube 22. The glass wool plug or plugs and the adsorbent drop into the funnel 15. The screen 16 retains the glass wool plug or plugs and the adsorbent particles drop into the sample vial 14. Any adsorbent particle adhering to the glass wool on the screen 16 is removed by scraping with probe 17.

The quantity of chemical contaminate in the air collected on the adsorbent is then determined using standard analytical techniques.

What is claimed is:

1. A laboratory stand assembly comprising a base, a support extending vertically from said base, a sample holder adjustably positioned on said support for vertical movement, a clamp member attached to an upper and of said sample holder to horizontally secure an adsorption tube containing a sample thereto, an adsorption tube horizontally secured in said clamp member, a donut shaped member contacting said base and positioned adjacent to said vertically extending support for receiving a sample receiving vial therein, a funnel having a cut out portion on the side thereof for insertion of one end of said adsorption tube and a discharge end adapted to be received by a sample receiving vial, said funnel containing a screen positioned therein and probe means to discharge an adsorbent and glass wool plugs from said adsorbtion tube into said funnel.

2. The laboratory stand assembly according to claim 1 wherein said sample holder is adjusted vertically in said support by means of a set screw positioned in a slot in said support member.

3. The laboratory stand assembly in accordance with claim 1 wherein said clamp is attached to the top of said sample holder by means of a set screw.

4. The laboratory stand assembly according to claim 3 wherein said clamp is adjustable by means of a set screw to hold said adsorption tube firmly in place.

* * * * *